US006608604B1

(12) United States Patent
Sharaiha et al.

(10) Patent No.: US 6,608,604 B1
(45) Date of Patent: Aug. 19, 2003

(54) HELICAL ANTENNA WITH BUILT-IN DUPLEXING MEANS, AND MANUFACTURING METHODS THEREFOR

(75) Inventors: Ala Sharaiha, Rennes (FR); Jean-Marc Toureilles, Lorient (FR); Claude Terret, Rennes (FR); Jean-Pierre Blot, La Turbie (FR)

(73) Assignee: France Telecom, Paris (FR)

( * ) Notice: Subject to any disclaimer, the term of this patent is extended or adjusted under 35 U.S.C. 154(b) by 0 days.

(21) Appl. No.: 09/142,967

(22) PCT Filed: Mar. 13, 1997

(86) PCT No.: PCT/FR97/00456

§ 371 (c)(1),
(2), (4) Date: Mar. 15, 1999

(87) PCT Pub. No.: WO97/35357

PCT Pub. Date: Sep. 25, 1997

(30) Foreign Application Priority Data

Mar. 19, 1996 (FR) ..... 96 03699

(51) Int. Cl.[7] ..... H01Q 1/24; H01Q 1/36
(52) U.S. Cl. ..... 343/895; 343/702
(58) Field of Search ..... 343/702, 895, 343/853, 700 MS; H01Q 1/24, 1/36

(56) References Cited

U.S. PATENT DOCUMENTS 4,008,479 A 2/1977 Smith ..... 343/895
5,235,296 A 8/1993 Saka ..... 333/109
5,255,005 A * 10/1993 Terret et al. ..... 343/895
5,581,268 A * 12/1996 Hirshfield ..... 343/895
5,828,348 A * 10/1998 Tassoudji et al. ..... 343/895

FOREIGN PATENT DOCUMENTS

EP 0 427 654 A1 4/1991
WO WO 92 05602 A 4/1992

OTHER PUBLICATIONS

Adams et al., The Quadrifilar Helix Antenna, IEEE Transactions on Antennas and Propagation, vol. 22, No. 2, Mar. 1994, New York US, pp. 173–178.
Shumaker et al., Printed Half–wave Length Quadrifilar Helix Antenna for GPS Marine Applications, Electronics Letters, vol. 32, No. 3, Feb. 1, 1996.

* cited by examiner

*Primary Examiner*—Hoanganh Le
(74) *Attorney, Agent, or Firm*—Kinney & Lange, P.A.

(57) ABSTRACT

The invention relates to a helix antenna with integrated duplexing means comprising two decoupled coaxial helices, each formed by radiating strands (111 to 114) printed on a substrate, each of the helices being associated with an independent and miniaturized structure (12, 13, 14) for the wideband supply of the radiating strands, the supply structures being printed on the corresponding substrate and comprising at least one hybrid coupler (12, 13, 14) made out of semi-localized elements so as to reduce the dimensions thereof. Advantageously, the helices are wound in opposite directions of winding (17) and their points of excitation are offset with respect to each other, in a plane perpendicular to the axis of the helices. Corresponding methods of manufacture are used to form the helix antenna.

11 Claims, 6 Drawing Sheets

HELICAL ANTENNA WITH BUILT-IN DUPLEXING MEANS, AND MANUFACTURING METHODS THEREFOR

BACKGROUND OF THE INVENTION

The field of the invention is that of wide passband antennas with hemispherical or quasi-hemispherical radiation patterns. More specifically, the invention relates to resonant helix antennas working in two neighbouring frequency bands that correspond to transmission and reception, and especially to the decoupling of these two channels, and hence to the duplexer function.

The antenna of the invention can find application especially in mobile satellite communications between users in fixed positions and moving bodies of all kinds for example, aeronautical, maritime or land-based bodies. In this field, several satellite communication systems are being implemented or are currently being developed (these include, for example, the INMARSAT, INMARSAT-M, GLOBALSTAR, and other systems). These antennas are also valuable in the deployment of personal communications systems (PCS) using geostationary satellites.

For all these systems, which provide for links with geostationary satellites, the very great difference in incidence between the signals received or transmitted requires that the antenna should have a radiation pattern with hemispherical coverage. Furthermore, the polarisation has to be circular with a ratio of ellipticity of more than 5 dB in the useful band.

More generally, the invention can be applied in all systems requiring the use of a wide band, a radiation pattern with hemispherical coverage, circular polarisation and a good ratio of ellipticity.

In the above-mentioned fields of application, the antennas must have the above-mentioned characteristics either in a very wide passband in the range of 10% or in two neighbouring sub-bands respectively corresponding to reception and transmission.

The patent FR-89 14952 filed on behalf of the present Applicant has already described a known type of antenna well suited to such applications.

This antenna, called a resonant quadrifilar helix (RQH) antenna has characteristics very close to the criteria laid down in a frequency band generally limited to 5% owing to problems of impedance matching. Operation on two bands is possible by using dual-layer RQH antennas. These antennas are formed by the concentric "nesting" of two electromagnetically coupled coaxial resonant quadrifilar helices.

A quadrifilar antenna is formed by four radiating strands. An exemplary embodiment is described in detail in A. Sharaiha and C. Terret, "Analysis of quadrifilar resonant helical antenna for mobile communications", IEEE—Proceedings H, Vol. 140, No. 4, August 1993.

In this structure, the radiating strands are imprinted on a thin dielectric substrate and then wound on a cylindrical medium that is radioelectrically transparent. The four strands of the helix are open or short-circuited at one end and electrically connected at the other end with conductive segments positioned on the base of the lower part of the supporting cylinder. The four strands of the helix are therefore excited through these conductive segments.

This antenna conventionally requires a supply circuit that excites the different antenna strands by signals having the same amplitude in phase quadrature. There are several known techniques used to obtain a supply circuit of this kind.

In the above-mentioned document "Analysis of quadrifilar resonant helical antenna for mobile communications", this function is fulfilled by means of a structure using couplers (3 dB, −90°) and a hybrid ring. This assembly is implanted on a printed circuit placed at the base of the antenna.

This technique has the advantage of being relatively simple to make and implement. By contrast, it leads to a non-negligible space requirement as compared with the antenna (which for example may have a size of about ten centimeters). This drawback makes this approach incompatible with many applications, especially when maximum miniaturisation is required.

According to a second technique described in J. L. Wong and H. E. King, "UHF satellite array nulls adjacent signals" (Microwaves & RF, March 1984), each bifilar helix may be supplied by a "folded balun" type of coaxial symmetrizer. The two bifilars helices are then excited in phase quadrature by means of a hybrid coupler.

The advantage of this method is that it requires the use of only one external hybrid element. By contrast, the symmetrizer/adapter assembly used for this type of antenna (made for example out of a coaxial section whose core and sheath form a dipole) is complex and bulky.

Furthermore, this type of assembly has the drawback of forming a sort of passband filter with a band that is still excessively narrow.

A third, more complex technique is described in C. C. Kilgus, "Resonant quadrifilar helix" (Microwave Journal, December 1970). The coaxial supply line is split at its end to form a symmetrizer. The phase quadrature is provided by adjusting the length of the strand.

This technique is used to eliminate hybrid couplers. However, it has the drawback of requiring a delicate adjustment of the length of the strand. Furthermore, the antenna is no longer symmetrical and the structure will be more complex. Besides, this method remains specifically reserved for systems using a narrow working band.

In the case of two-way antennas having to carry out the transmission and the reception of signals, it is naturally necessary, as far as possible, to decouple the transmission frequency band and the reception frequency band, which are generally close to each other.

This is the role of the duplexer which is generally placed at the supply point of the antenna. There are several known types of duplexer. Gord Neilson and John Mchory, "RF filters and diplexers for cellular applications" (Antem '90) describes several types of duplexers used in the field of radiocommunications.

In general, these known devices have the drawback of taking the form of an element that is independent and complementary to the antenna. They therefore entail considerable space requirements, especially when the antennas are very small-sized.

Furthermore, these are elements that are complicated to make and implement. Consequently, their cost price is great as compared with the cost of the antenna itself.

Finally, these duplexers act as filters and may therefore introduce losses of useful parts of signals.

SUMMARY OF THE INVENTION

The invention is aimed in particular at overcoming these different drawbacks of the prior art.

More specifically, an aim of the invention is to provide an antenna and its system of supply (hereinafter the term "antenna" includes the antenna proper as well as its supply system) having two sub-bands that are sufficiently decoupled not to require the presence of an additional standard duplexer.

In other words, the invention is aimed at providing a two-way antenna that fulfils the duplexing function in a simple and efficient manner without using known duplexers.

Another aim of the invention is to provide an antenna of this kind that has a low cost price and can easily be made on an industrial scale. In particular, the invention is aimed at providing an antenna of this kind that can be manufactured in a very small number of successive operations.

Another aim of the invention is to provide an antenna of this kind that does not require specific and complex setting operations.

Yet another aim of the invention is to provide an antenna of this kind (and especially the supply system of such an antenna) taking up little space as compared with known devices.

The invention is also aimed at providing an antenna of this kind that achieves an equal-amplitude excitation of the four strands and a precise phase quadrature relationship and hence high quality of circular polarisation in both sub-bands.

These aims as well as others that shall appear hereinafter are achieved according to the invention by means of a helix antenna with integrated duplexing means comprising two decoupled coaxial helices, each formed by radiating strands printed on a substrate, each of said helices being associated with an independent and miniaturised structure for the wideband supply of said radiating strands, said supply structures being printed on said corresponding substrate and comprising at least one hybrid coupler made out of semi-localised (or "non uniformly spaced") elements so as to reduce the dimensions thereof.

The making of the antenna strands and of the supply structure in the form of printed elements enables the production of the antenna, its supply structure and the duplexer in one and the same operation without any specific connection means and in a particularly small format.

The use of hybrid couplers made out of semi-localised elements can be used to obtain the set of desired qualities, and especially to reduce the space requirement of the assembly as compared with conventionally used lines.

Since the two layers forming each of said coaxial helices are perfectly decoupled, this structure directly fulfils the role of a duplexer without any additional element. The supply points of each of the helices respectively and directly correspond to the transmission signal and to the reception signal.

Thus, a very simple low cost two-way antenna is obtained.

Advantageously, said helices, when they are laid out flat, have strands with directions that are symmetrical to the axis of said antenna and are wound in opposite directions of winding so that said strands are substantially parallel.

This technique enables the printed face of the internal helix to be pointed inwards and that of the external helix to be pointed outwards.

Preferably, in order to decrease the decoupling, the points of excitation of said quadrifilar helices are offset with respect to each other in a plane perpendicular to the axis of said helices. According to one advantageous embodiment, they are offset by 135°.

The invention can be applied to all types of helix antennas. According to a preferred embodiment, said helix is a quadrifilar helix, formed by four radiating strands supplied by a supply structure comprising three hybrid couplers.

Advantageously, in the last-named case, said supply structure comprises a first 180° hybrid coupler associating a supply input and/or output of said antenna with two intermediate outputs and/or inputs phase-shifted by 180° and two 90° hybrid couplers each associating one of said intermediate outputs and/or inputs of said first hybrid coupler with one of the ends of two of said radiating strands.

According to an advantageous embodiment of the invention, said antenna is mounted on a support having a first part and a second part that are distinct with different values of permittivity, said first part bearing said radiating strands and said second part bearing said supply structure.

Preferably, said first part bearing the antenna strands has a permittivity greater than 1.

It is thus possible to further reduce the amount of space taken up by the antenna.

An antenna of this kind as described here above may be used alone or in an array of antennas.

The invention also relates to the manufacture of said antennas. This manufacture is particularly simplified as compared with the prior art techniques.

According to a first method of manufacture of a resonant helix antenna, the following steps are planned:

the printing, on a plane substrate, of at least two radiating antennas designed to form a helix and of an independent, miniaturised structure for the wideband supply of said radiating strands comprising at least one hybrid coupler made out of semi-localised elements so as to reduce the dimensions thereof;

the winding of said substrate around a cylindrical support.

According to a second method of manufacture of a resonant helix antenna that is even more simple to implement, the following steps are performed:

the obtaining of a cylindrical support bearing a substrate;

the printing, on said substrate, of at least two radiating antennas designed to form a helix and an independent, miniaturised structure for the wideband supply of said radiating strands comprising at least one hybrid coupler made out of semi-localised elements so as to reduce the dimensions thereof.

BRIEF DESCRIPTION OF THE DRAWINGS

Other features and advantages of the invention shall appear from the following description of a preferred embodiment of the invention given as a simple and non-restricted example, and from the appended figures wherein:

FIG. 7A shows a standard coupler with distributed elements;

FIG. 7B shows a corresponding view using p cells;

FIG. 7C shows a corresponding microstrip line coupler;

FIG. 8A shows a 180° hybrid ring;

FIG. 8B shows a corresponding microstrip line coupler;

DETAILED DESCRIPTION

The invention therefore relates to an antenna with wideband supply system with integrated duplexer made according to a simple, low-cost manufacturing technique.

As indicated here above, the invention can be applied to any type of helix antenna. The preferred embodiment described here relates to a quadrifilar helix antenna.

According to the invention, the antenna has two coaxial helices respectively providing for transmission and reception. Each of these helices is formed by four strands printed on a substrate on which a supply structure is printed conjointly.

Thus, in a single operation, the antenna, supply and duplexer operations are implanted. This makes it possible to obtain a highly compact antenna with a very low cost price.

A detailed description shall now be given of the first helix forming the layer.

Figure 1:
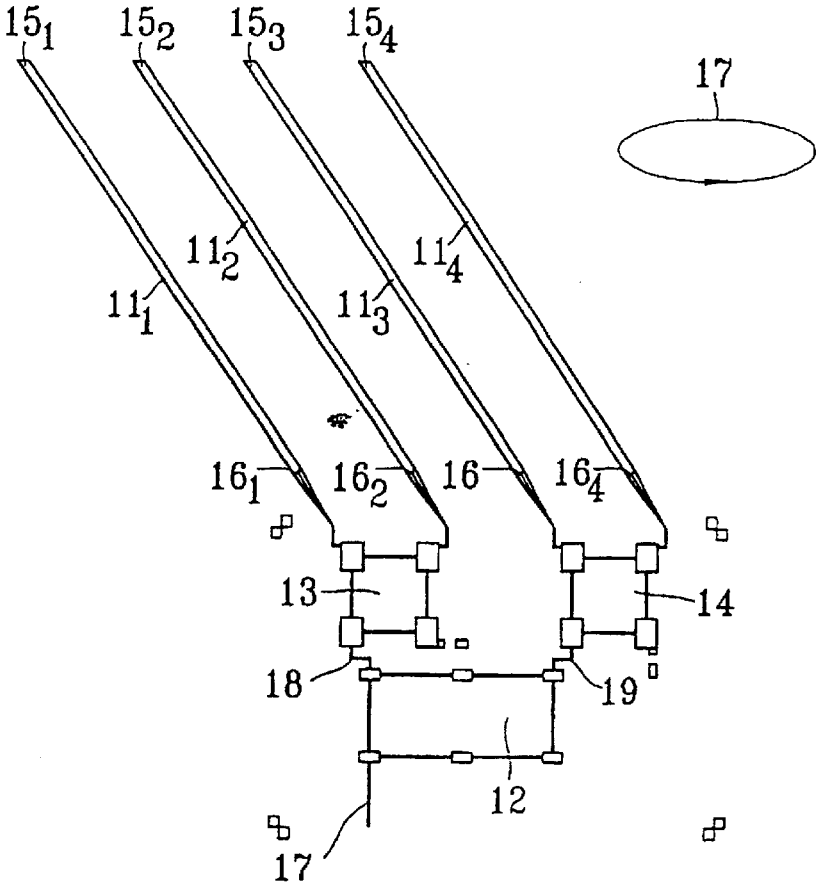
FIG. 1 exemplifies a quadrifilar helix with integrated supply according to the invention forming the external layer of the antenna, laid out in a flat representation.

FIG. 1 illustrates the printed elements when the helix is laid out flat.

It comprises first of all, four radiating antenna strands $\mathbf{11}_1$ to $\mathbf{11}_4$.

One mode of determining the characteristics of these strands is given for example in the patent FR-89 14952 already referred to.

The dimensions of the antenna vary as a function of the frequency band and the coverage values required. For example, the dimensions of this antenna may be as follows:

length: 90 mm;

width: 2 mm;

thickness: 35 $\mu$m;

angle of inclination: 54.5°.

They are made for example of copper on a thin dielectric substrate such as kapton (epsilon, approximately equal to 3.8).

The four strands $\mathbf{11}_1$ to $\mathbf{11}_4$ are preferably open at their upper end $\mathbf{15}_1$ to $\mathbf{15}_4$. They may also be short-circuited. However, the system of the invention is particularly appropriate to the excitation of antennas with strands that are more open and, for equal performance characteristics, possess dimensions that are smaller than those of the short-circuited strand antennas.

The other end $\mathbf{16}_1$ to $\mathbf{16}_4$ of the strands is connected to the feeder lines of the supply circuit.

The supply system is made on the same substrate, in the extension of the antenna. It is formed by three hybrid couplers 12, 13 and 14 designed as semilocalised or non-uniformly spaced elements.

The first hybrid coupler 12 is connected firstly to the input (and output respectively depending on the use) 17 of the antenna signal and secondly to the two inputs (and outputs respectively) 18 and 19 of the other two couplers 13 and 14. It is a 180° hybrid coupler.

The hybrid couplers 13 and 14 are two identical 90° couplers. They are connected firstly to the input 18 (and 19 respectively) and secondly to the end of the strands 16, and 162 (and 163 and 164 respectively).

Thus the four strands are supplied in perfect phase quadrature on a wideband.

The assembly thus obtained is then wound on a support that is cylindrical in the trigonometric sense. The winding is done towards the exterior (the printed circuits being on the exterior of the cylinder) to obtain the external helix shown in a front view in FIG. 2.

The cylindrical support is a support that is radioelectrically transparent, namely it has a permittivity close to 1.

It must be noted that it is easy to further reduce the height of the assembly by using a support with a permittivity greater than 1 for the part corresponding to the antenna strands.

Figure 3:
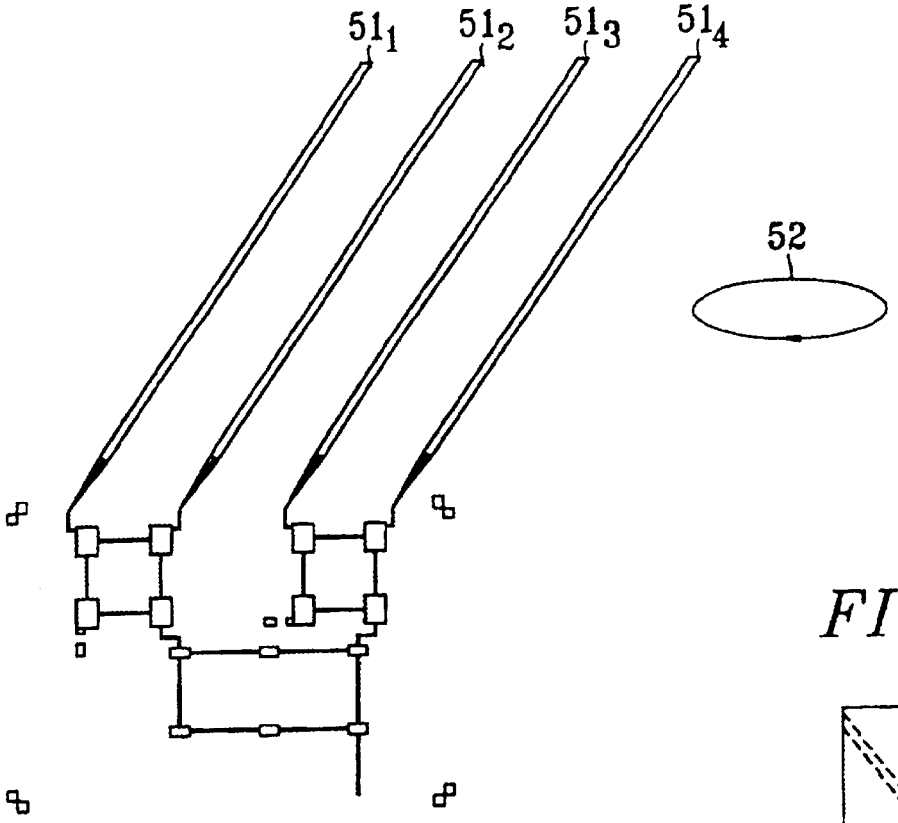
FIG. 3 illustrates a second quadrifilar helix with integrated supply according to the invention forming the internal layer of the antenna, laid out in a flat representation.

FIG. 3 illustrates the elements forming the internal layer of the antenna, laid out in a flat representation. These elements are quite similar to those described with reference to FIG. 1 except that the antenna strands $\mathbf{51}_1$ to $\mathbf{51}_4$ are inclined in the opposite direction, the winding direction 52 being opposite the winding direction 17 of the first helix.

In this example, the dielectric substrate is identical to that of FIG. 1. The supply system 53 is also in the extension of the antenna strands $\mathbf{51}_1$ and $\mathbf{51}_4$ and is made of semi-localised elements.

Figure 4:
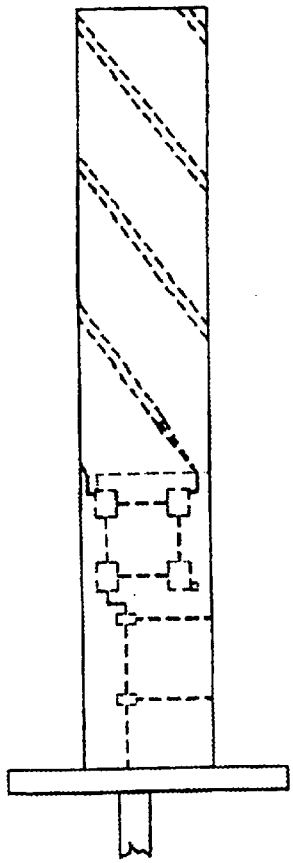
FIG. 4 shows the helix of FIG. 3 wound cylindrically so as to form a second operational helix.

The assembly is then wound towards the interior (arrow 52) on a support that is transparent from the radioelectrical point of view, to give the internal helix of FIG. 4.

Figure 5:
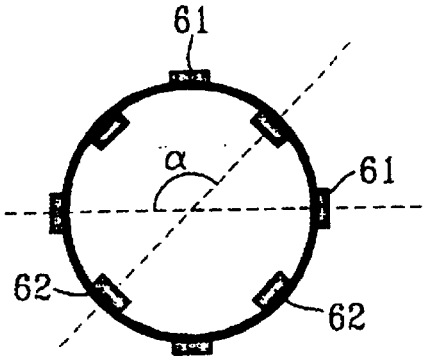
FIG. 5 shows a sectional view of the mounted antenna comprising the helices of FIGS. 2 and 4, mounted so as to be offset.

The two layers thus obtained are finally mounted concentrically with respect to one another as is shown in the sectional view of FIG. 5.

The external layer (formed by external conductors 61) and the internal layer (formed by internal conductors 62) are offset by an angle a=135° with respect to their excitation points.

Figure 6:
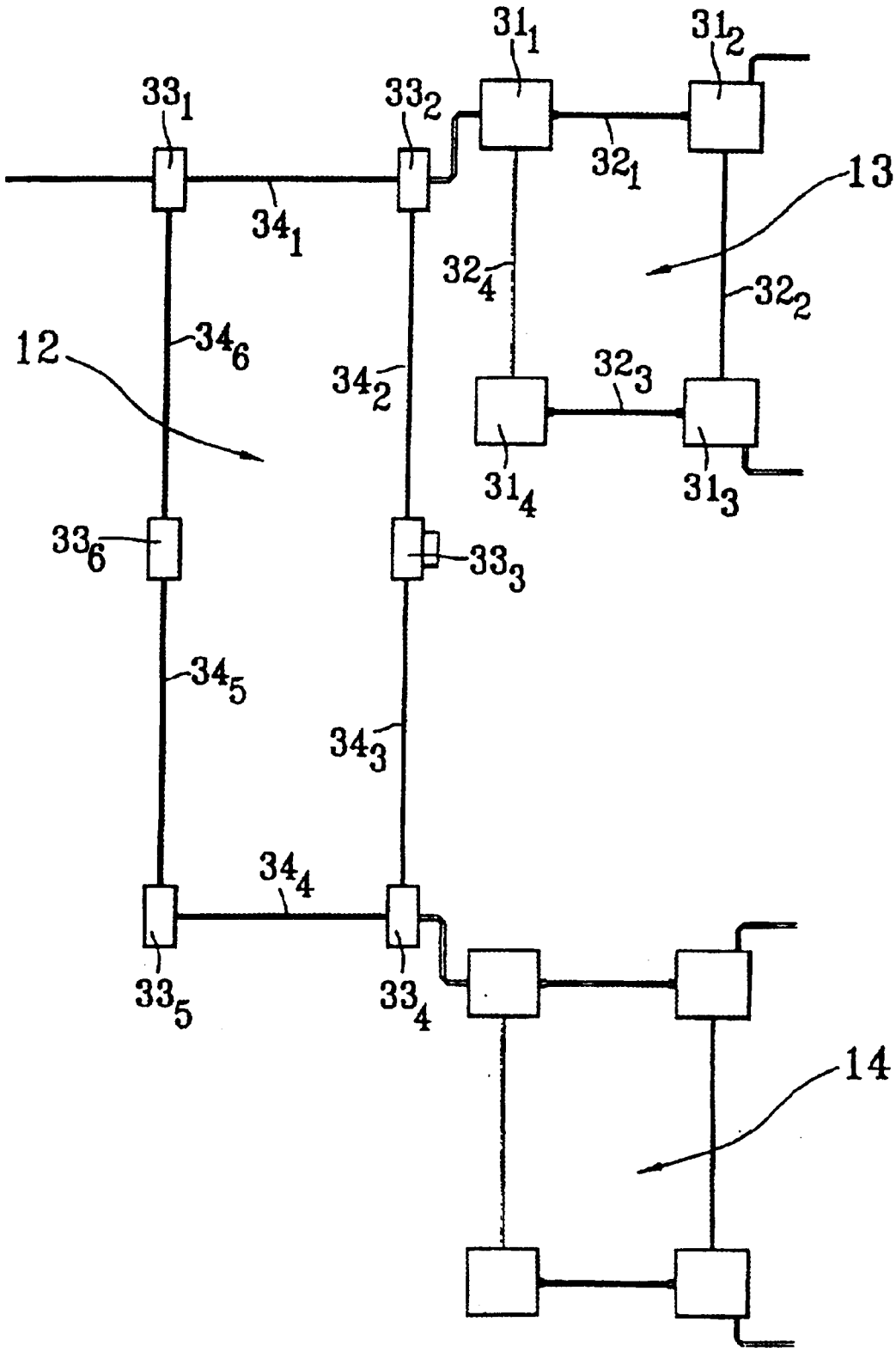
FIG. 6 gives a more detailed view of the supply structure of FIGS. 1 and 3.

FIG. 6 gives a more precise view of the supply structure using semilocalised elements according to the invention, magnified substantially by a factor of 3 with respect to its real size. It comprises two types of printed lines:

lines of small width having an inductive characteristic;

wider lines having a capacitive characteristic.

Thus, the 90° couplers 13 and 14 are each formed by four wide elements $\mathbf{31}_1$ and $\mathbf{31}_4$ connected in pairs of two by four lines of small width 321 to 324. The 190° coupler has six wide elements 331 to 336 connected by six lines of small width 341 to 346.

Figure 7A:
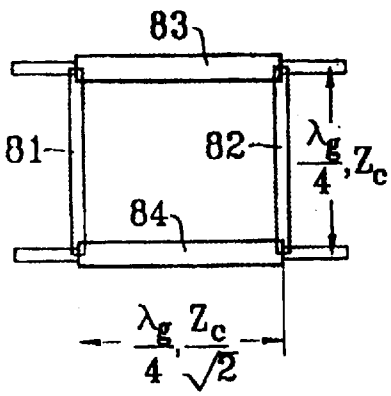
FIGS. 7A to 7C illustrate the design of a −3 dB, 90° coupler according to the invention.
Figure 7B:
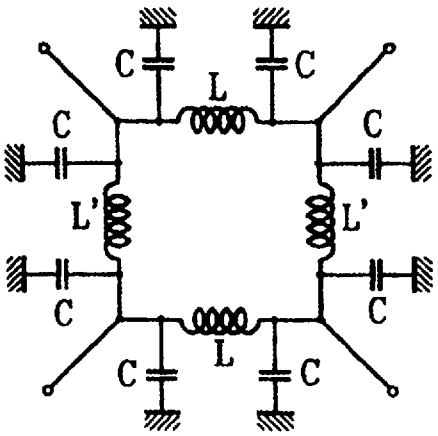
Figure 7C:
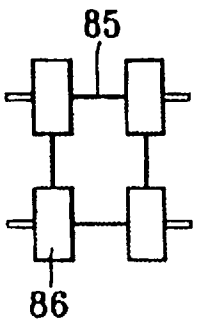

FIGS. 7A and 7C illustrate the design of a −3 dB 90° coupler.

More substantial details can be found if necessary in the thesis by M.

Coupez, Université de Bretagne Occidentale, "Etude de structures de déphaseurs potentiellement intégrables á 900 MHz" (Study of phase-shifter structures that can be potentially integrated at 900 MHz), May 1988.

FIG. 7A is the standard drawing of a −3 dB 90° coupler made of distributed elements. It has two line sections 81, 82 with a length lg/4 and a characteristic impedance Zc and two line sections 83, 84 with a length lg/4 and a characteristic impedance Zc/√2.

Each of these two line sections can be replaced by π-shaped cells of localised elements formed by capacitors C and inductors L and L', as illustrated in FIG. 7B.

By using the inductive properties (lines of small width 85) and capacitive properties (wider lines 86) of the microstrip lines, it is then possible to again transform the coupler made of distributed elements as shown in FIG. 7C.

Figure 8A:
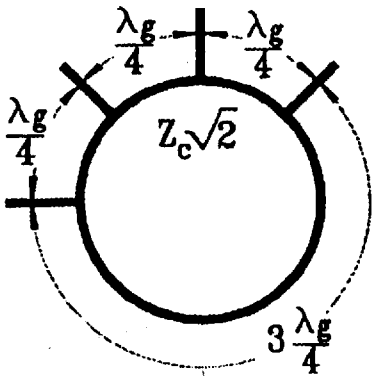
FIGS. 8A and 8B illustrate the design of a −3 dB 180° coupler.
Figure 8B:
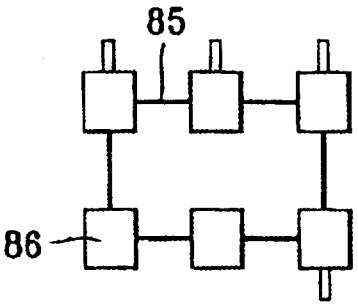

The same procedure is used to convert the standard structure of a −3 dB, 180° hybrid ring shown in FIG. 8A into a coupler with semi-localised elements illustrated in FIG. 8B.

A helix of this kind especially has the following advantages:

- it has open strands, hence the impedance of each strand can easily be matched to 50Ω for an antenna having the desired properties (hemispherical coverage and low reverse polarisation);
- the supply structure using hybrids is a wideband structure that is perfectly balanced:
  in amplitude (identical for each strand); and
  in phase (0°; ±90°; ±180°; ±270°);
- the dimensions of the supply device are smaller than those of known systems (a gain of 50% may be obtained). Indeed, it can easily be seen that each semi-localised element has a size far smaller than that of the line that replaces it (which is generally a size that is a multiple of ¼);
- the antenna has high strand-to-strand insulation.

By way of an indication, the following are the results of measurements with a particular embodiment, designed for communications with equipment and communications at close range.

The dimensions of the assembly formed by the antenna and the integrated supply are as follows:

diameter: 26 mm;

height: 130 mm:

total weight: 70 g.

The radioelectrical characteristics measured are:

transmission: 2.17–2.2 GHz;

reception: 1.98–2.01 GHz;

polarisation: right circular;

coverage: 180°;

ellipticity: <5 dB for Q<90°
<2 dB for Q<75°;

defect of omnidirectionality: ±0.6 dB on the horizon.

Figure 9:
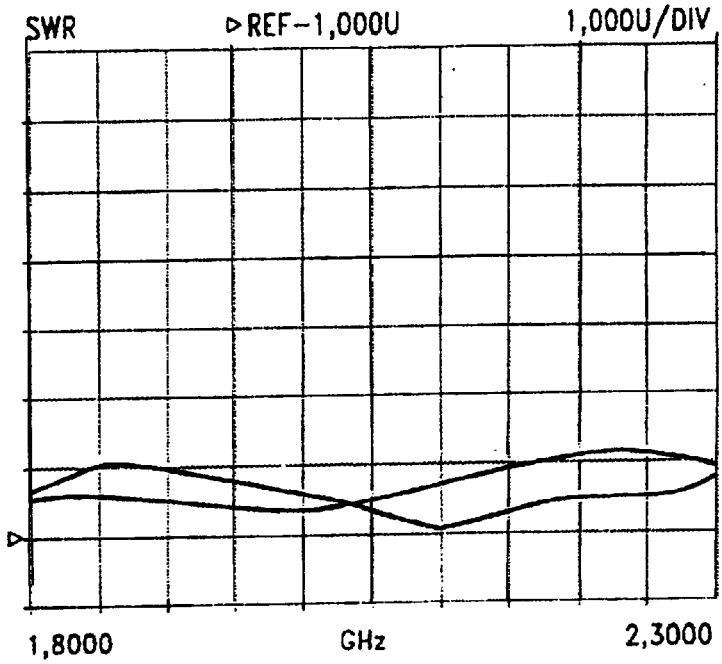
FIG. 9 illustrates the standing wave ratio (SWR) of a particular embodiment of the antenna of FIGS. 1 and 2.

FIG. 9 shows the standing wave ratio (SWR) at the input of each antenna as a function of the frequency of each of the helices. It can be seen that an SWR of less than 2 is obtained for each antenna in a 400 MHz band.

Figure 10:
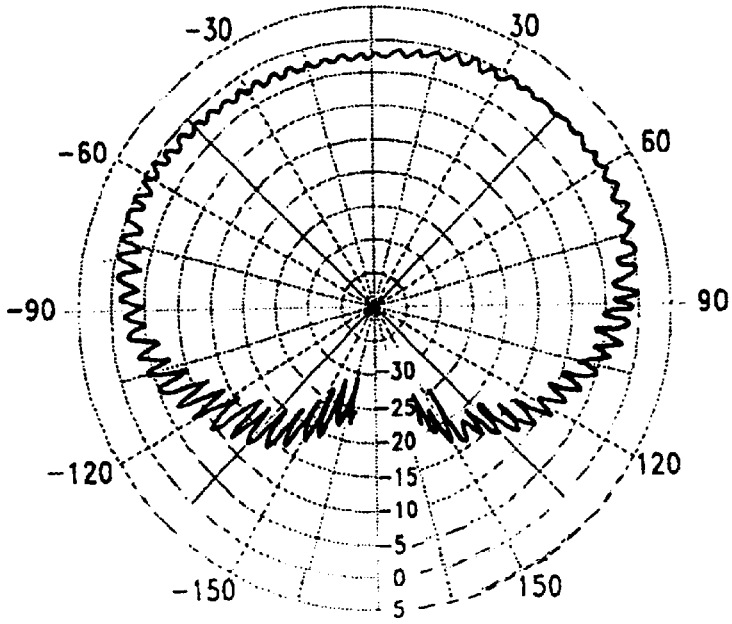
FIGS. 10 and 11 show radiation patterns, measured in right circular polarisation and left circular polarisation, of the same embodiment, respectively at the frequencies 1.98 GHz and 2.2 GHz.
Figure 11:
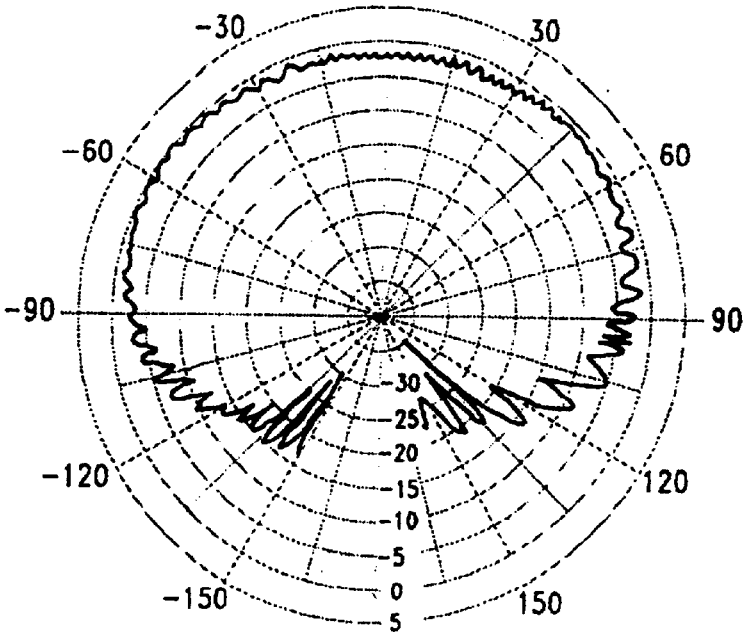

FIGS. 10 and 11 pertain to the radiation patterns measured in right circular polarisation (a) and in left circular polarisation (b) with a dipole rotating respectively at the frequencies 1.98 GHz (FIG. 10) and 2.2 GHz (FIG. 11).

It can be seen that the following are obtained:

- a mean aperture at −3 dB that is quasi-hemispherical and greater than 180°;
- a rejection of the reversed polarisation greater than −15 dB throughout the coverage.

Figure 12:
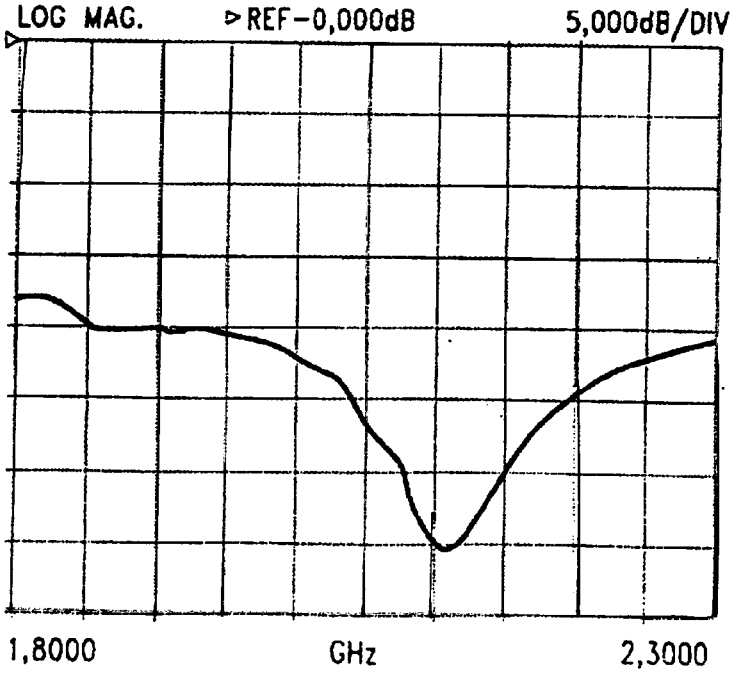
FIG. 12 shows the decoupling ($S_{21}$) between the two helices.

FIG. 12 shows that the decoupling between the two helices is greater than 20 dB.

An antenna according to the invention can be made in various ways.

Figure 2:
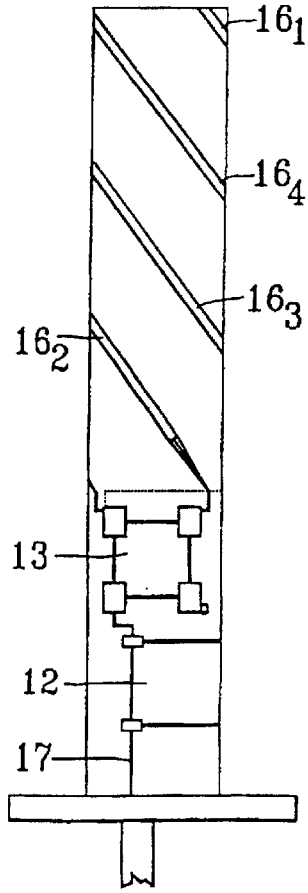
FIG. 2 shows the helix of FIG. 1, wound cylindrically, so as to form a first operational helix.

Thus, according to a first embodiment, the helices can be printed flat as shown in FIGS. 1 and 3. They are then wound on a support to form the antenna (FIGS. 2 and 4).

According to another embodiment that is even speedier, the substrate designed to receive the printed elements may be made directly in its definitive cylindrical shape. In this case, the printing of the strands and of the supply structure is done directly on the cylinder.

Furthermore, it must be noted that although it can be used as a unit, the antenna of the invention advantageously lends itself to the making of antenna arrays.

What is claimed is:

1. A helix antenna with integrated duplexing means, characterized in that it comprises two decoupled coaxial helices, each formed by radiating strands printed on a substrate, each of said helices being associated with a distinct supply structure, each supply structure being an independent, miniaturised structure for the wideband supply of said radiating strands, said supply structures being printed on said substrate and comprising at least one hybrid coupler made out of semi-localised elements, said semi-localised elements being designed according to the following steps:

- designing said coupler with conventional distributed stripline elements, each of them having at least a $\lambda/4$ length;
- turning each of said distributed stripline elements into lumped elements, each of them being a $\pi$ cell made of one capacitance C and two inductances L,L'; and
- turning each of said capacitances and inductances into semi-localised elements, each of said inductances being turned into a reduced width line and each of said capacitances being turned into a larger width line, each of said lines being smaller than $\lambda/4$.

2. An antenna according to claim 1, characterised in that said helices, when they are laid out flat, have strands with directions that are symmetrical to the axis of said antenna and are wound in opposite directions of winding so that said strands are substantially parallel.

3. An antenna according to claim 1, in that points of excitation of said helices are offset with respect to each other in a plane perpendicular to an axis of said helices.

4. An antenna according to claim 3, characterised in that the points of excitation are offset by 135°.

5. An antenna according to claim 1, in that said helices are quadfilar helices, each formed by four radiating strands supplied by a supply structure comprising three hybrid couplers.

6. An antenna according to claim 5, characterised in that each of said supply structures comprises a first 180° hybrid coupler associating a supply input and/or output of said antenna with two intermediate outputs and/or inputs phase-shifted by 180° and two 90° hybrid couplers each associating one of said intermediate outputs and/or inputs of said first hybrid coupler with one of the ends of two of said radiating strands.

7. An antenna according to claim 1, in that at least one of said helices is mounted on a support having a first part and a second part that are distinct with different values of permittivity, said first part bearing said radiating strands and said second part bearing said supply structure.

8. An antenna according to claim 7, characterised in that said first part bearing the antenna strands has a permittivity greater than the permittivity of said second part.

9. An antenna according to claim 1, wherein said helices are quadrifilar.

10. A method for the manufacture of a helix antenna with integrated miniaturised duplexing and supply means comprising two decoupled coaxial helices, characterised in that said method comprises, for each of said helices, the following steps:

- the printing, on a plane substrate, of at least two radiating antennas designed to form a helix and of a supply structure for each helix, each supply structure being an independent, miniaturised structure for the wideband supply of said radiating strands comprising at least one hybrid coupler made out of semi-localised elements, said semi-localized elements being designed according to the following steps:

designing said coupler with conventional distributed stripline elements, each of them having at least a $\lambda/4$ length;

turning each of said distributed stripline elements into lumped elements, each of them being a $\pi$ cell made of one capacitance C and two inductances L,L'; and turning each of said capacitances and inductances into semi-localised elements, each of said inductances being turned into a reduced width line and each of said capacitances being turned into a larger width line, each of said lines being smaller than $\lambda/4$;

so that the space requirement of each of said supply structures is smaller than $\lambda/4$, $\lambda$ being the maximum wavelength of operation of said antenna; and the winding of said substrate around a cylindrical support.

11. A method for the manufacture of a helix antenna with integrated miniaturised duplexing and supply means comprising two decoupled coaxial helices, characterised in that said method comprises, for each of said helices, the following steps:

the obtaining of a cylindrical support bearing a substrate;

the printing, on said substrate, of at least two radiating antennas designed to form a helix and a supply structure for each helix, each supply structure being an independent, miniaturised structure for the wideband supply of said radiating strands comprising at least one hybrid coupler made out of semi-localised elements, said semi-localized elements being designed according to the following steps:

designing said coupler with conventional distributed stripline elements, each of them having at least a $\lambda/4$ length:

turning each of said distributed stripline element into lumped elements, each of them being a $\pi$ cell made of one capacitance C and two inductances L,L'; and turning each of said capacitances and inductances into semi-localised elements, each of said inductances being turned into a reduced width line and each of said capacitances being turned into a larger width line, each of said lines being smaller than $\lambda/4$, so that the space requirement of each of said supply structures is smaller than $\lambda/4$, $\lambda$ being the maximum wavelength of operation of said antenna.

* * * * *

UNITED STATES PATENT AND TRADEMARK OFFICE

CERTIFICATE OF CORRECTION

PATENT NO. : 6,608,604 B1
DATED : August 19, 2003
INVENTOR(S) : Ala Sharaiha et al.

It is certified that error appears in the above-identified patent and that said Letters Patent is hereby corrected as shown below:

Column 6,
Line 8, delete "16," and insert -- $16_1$ --
Line 9, delete "162" and insert -- $16_2$ --
Line 9, delete "163" and insert -- $16_3$ --
Line 9, delete "164" and insert -- $16_4$ --

Signed and Sealed this

Thirtieth Day of December, 2003

JAMES E. ROGAN
*Director of the United States Patent and Trademark Office*